73-151 SR
3/6/84 OR 4,434,653

United States Patent [19]
Montgomery

[11] 4,434,653
[45] Mar. 6, 1984

[54] APPARATUS FOR TESTING EARTH FORMATIONS

[75] Inventor: Marshall N. Montgomery, Houston, Tex.

[73] Assignee: Dresser Industries, Inc., Dallas, Tex.

[21] Appl. No.: 398,477

[22] Filed: Jul. 15, 1982

[51] Int. Cl.[3] ..... E21B 49/10
[52] U.S. Cl. ..... 73/151; 73/155; 166/100
[58] Field of Search ..... 166/100; 73/151, 155

[56] References Cited

U.S. PATENT DOCUMENTS

| | | | |
|---|---|---|---|
| 3,011,554 | 12/1961 | Desbrandes et al. | 166/100 |
| 3,022,826 | 2/1962 | Kisling | 166/100 |
| 3,104,712 | 9/1963 | Whitten | 166/100 |
| 3,653,436 | 4/1972 | Anderson et al. | 166/100 |
| 3,780,575 | 12/1973 | Urbanosky | 73/152 |

*Primary Examiner*—Howard A. Birmiel
*Attorney, Agent, or Firm*—Richard M. Byron; Patrick H. McCollum

[57] ABSTRACT

Apparatus is provided for collecting a plurality of samples of fluids in earth formations traversed by a well bore. The sampling apparatus includes an elongated body member adapted to carry an extensible and retractible fluid admitting probe which is selectively placed in sealing engagement with potentially producible earth formations. The fluid admitting probe is coupled to a fluid passage which is selectively placed into fluid communication with a fluid sample collection chamber. A pressure control assembly located in the fluid passage intermediate the fluid admitting probe and the sample collection chamber maintains the pressure within at least a portion the fluid passage of a predetermined proportional minimum level of formation pressure during fluid sample collection.

16 Claims, 5 Drawing Figures

FROM FIG. 2A 114
116
84
88
134
118
126
128
162
120
26
160
164
162
130
24
PS
166
122
132
124
136
138
142
158
V
V
140
150
144
156
22
152
148
154
146
164
145
185
149
159
193
163
173
187
155
164b
153
175
191
147
177
181
164a
151
165
179
157
161
189
171
183
167
169
186
TO FIG. 2C

APPARATUS FOR TESTING EARTH FORMATIONS

BACKGROUND OF THE INVENTION

This invention relates, in general, to fluid samplers, and more particularly to apparatus for performing non-destructive collecting of fluid samples from subsurface earth formations traversed by a borehole.

The sampling of fluids contained in subsurface earth formations provides a method of testing formation zones of possible interest by recovering a sample of any formation fluids present for later analysis at the earth's surface while causing a minimum of damage to the tested formations. Thus, the formation sampler is essentially a point test of the possible producibility of subsurface earth formations. Additionally, a continuous record of the sequence of events during the test is made at the surface. From this record valuable formation pressure and permeability data can be obtained for formation reservoir analysis.

Early formation fluid sampling instruments, such as the one described in U.S. Pat. No. 2,674,313, were not fully successful as a commercial service because they were limited to a single test on each trip into the borehole. Later instruments were suitable for multiple testing, however, the success of these testers depended to some extent on the characteristics of the particular formations to be tested. For example, where earth formations were unconsolidated a different sampling apparatus was required than in the case of consolidated formations.

One major problem which has hampered the reliable testing of subsurface earth formations has been in designing a suitable system for preventing seal loss between an extensible packer element of the formation tester instrument, the formation at the initiation and during fluid sample collection. This problem is particularly acute in highly unconsolidated formations. A related problem has been in designing a system for eliminating the sudden pressure drop within the formation fluid sample line when the control valve controlling the fluid sample collection tank is opened. This sudden pressure drop can result in degeneration of the formation in the packer area causing a loss of seal between the packer and the formation resulting in contamination of the formation fluid sample.

In an effort to control the rate of fluid sample intake, and thus reduce the chances of packer seal loss, U.S. Pat. No. 3,022,826, issued to Kisling III, attempts to overcome the problem by employing a flexible bag member as a fluid sample collection chamber and by pressure balancing the flexible bag to reduce the rate of fluid sample intake. Another technique, for controlling the rate of fluid sample intake can be found in U.S. Pat. No. 3,653,436, issued to Anderson et al, which continuously employs formation pressure to slidably move a flow restricting cover from a position within the sample intake probe. As the flow restricting cover moves rearward within the probe a filter screen is gradually exposed allowing formation fluid flow into a sample collection tank. Yet another system for controlling initial flow rate, is disclosed in U.S. Pat. No. 3,780,575, issued to Urbanosky, where the flow restriction is controlled by a pressure ratio of borehole pressure to formation pressure, rather than simply based on formation pressure, as in Anderson et al. While these designs represent improvements, usage has shown them to be less than totally successful particularly in highly unconsolidated formations.

Accordingly, the present invention overcomes the deficiencies of the prior art by providing method and apparatus for obtaining a plurality of formation fluid samples under adverse formation conditions in a single traversal of the borehole.

SUMMARY OF THE INVENTION

Apparatus for obtaining a plurality of formation fluid samples according to the present invention includes a fluid admitting member adapted for establishing fluid communication between earth formations and a fluid sampling and measuring instrument. The fluid admiting member is telescopically extensible from the instrument into sealing engagement with potentially producible earth formations. A central tubular member coaxially disposed within a sealing member extends, penetrating any mud cakes and extending into the earth formations. When the fluid admitting member is fully extended a pre-test sample is taken through a bore located in the fluid admitting member. The pre-testing operation serves to pull any mud cakes and earth particles into the bore exposing to any formation fluids present a plurality of coaxially located passages within the fluid admitting member. Upon completion of a pre-test a sample pressure control value is activated thereby capturing a sample of the formation fluids at initial shut-in pressure. The captured formation fluids at initial shut-in pressure are used to bias a valve seal within a sample pressure control valve. Upon activation of a sample chamber control valve any collectable formation fluids present must overcome the pressure bias provided by the sample pressure control valve before fluid communication is established between the earth formations and the sample collection line. Upon completion of the sampling operation a sample chamber lock valve is activated trapping the formation fluid sample within the chamber and the pre-test sample is expelled through the collection member dislodging any mud cakes or earth formation particles contained in the central bore and the instrument is either relocated within the borehole for taking additional samples or is returned to the earth's surface where the collected samples can be analyzed.

DETAILED DESCRIPTION OF THE PREFERRED EMBODIMENT

Figure 1:
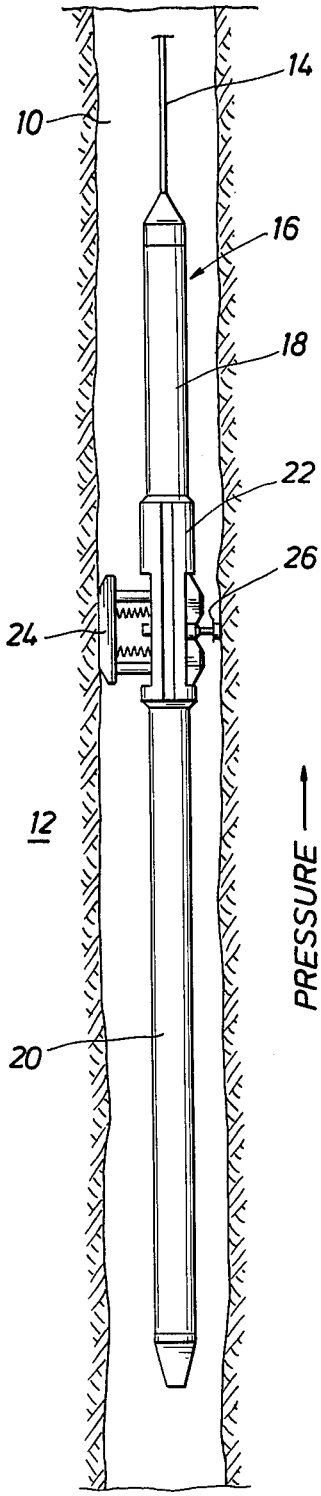
FIG. 1 is a pictorial view, partly in cross-section, of a formation testing instrument disposed in a borehole.

Referring now to the drawings in more detail, especially to FIG. 1, there is illustrated schematically a section of a borehole 10 penetrating a portion of the earth formations 12, shown in vertical section. Disposed within the borehole 10 by means of a cable or wireline 14 is a sampling and measuring instrument 16. The sample and measuring instrument 16 is comprised of a hydraulic power system section 18, a fluid sample storage section 20, and a sampling mechanism section 22. Sample mechanism section 22 includes selectively extensible well engaging pad member 24 and a selectively extensible fluid admitting member 26.

In operation, sampling and measuring instrument 16 is positioned within borehole 10 by means of cable 14 being wound on or unwound from a drum (not shown) located at the earth's surface. When sampling and measuring instrument 16 is disposed adjacent an earth formation of interest electrical control signals are transmitted through electrical conductors contained within cable 14 from a surface electronic assembly (not shown) to sampling and measuring instrument 16. These electrical control signals activate the hydraulic power system section 18 causing the well engaging pad member 24 and the fluid admitting member 26 to move laterally from sampling and measuring instrument 16 into engagement with the earth formations 12. Fluid admitting member 26 can then be placed in fluid communication with the earth formation 12 allowing for the taking of a sample of any producible connate fluids contained in the earth formations.

Figure 2A:
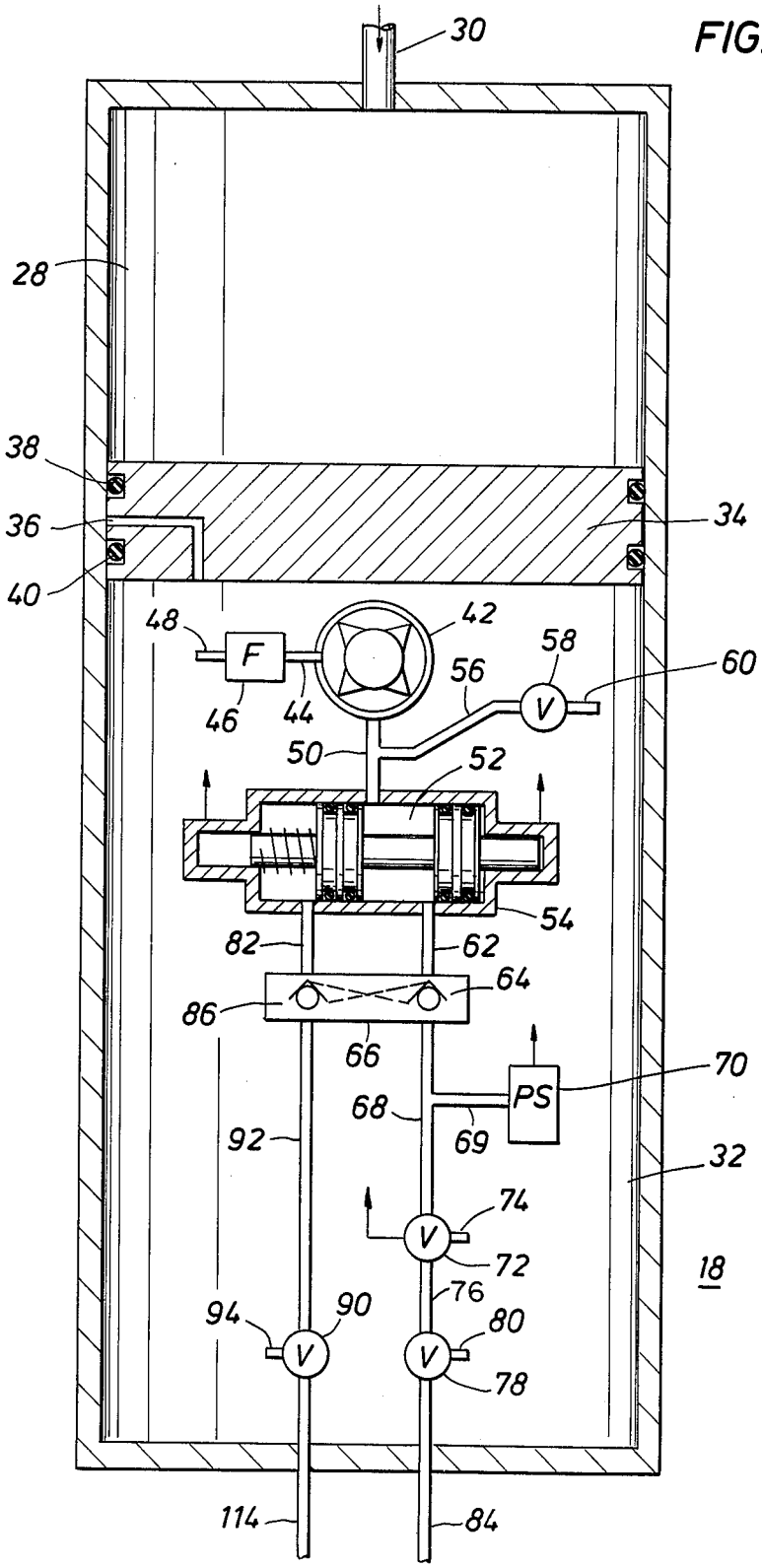
FIGS. 2A–2C together show a somewhat-schematic representation of the formation testing instrument illustrated in FIG. 1.
Figure 2B:
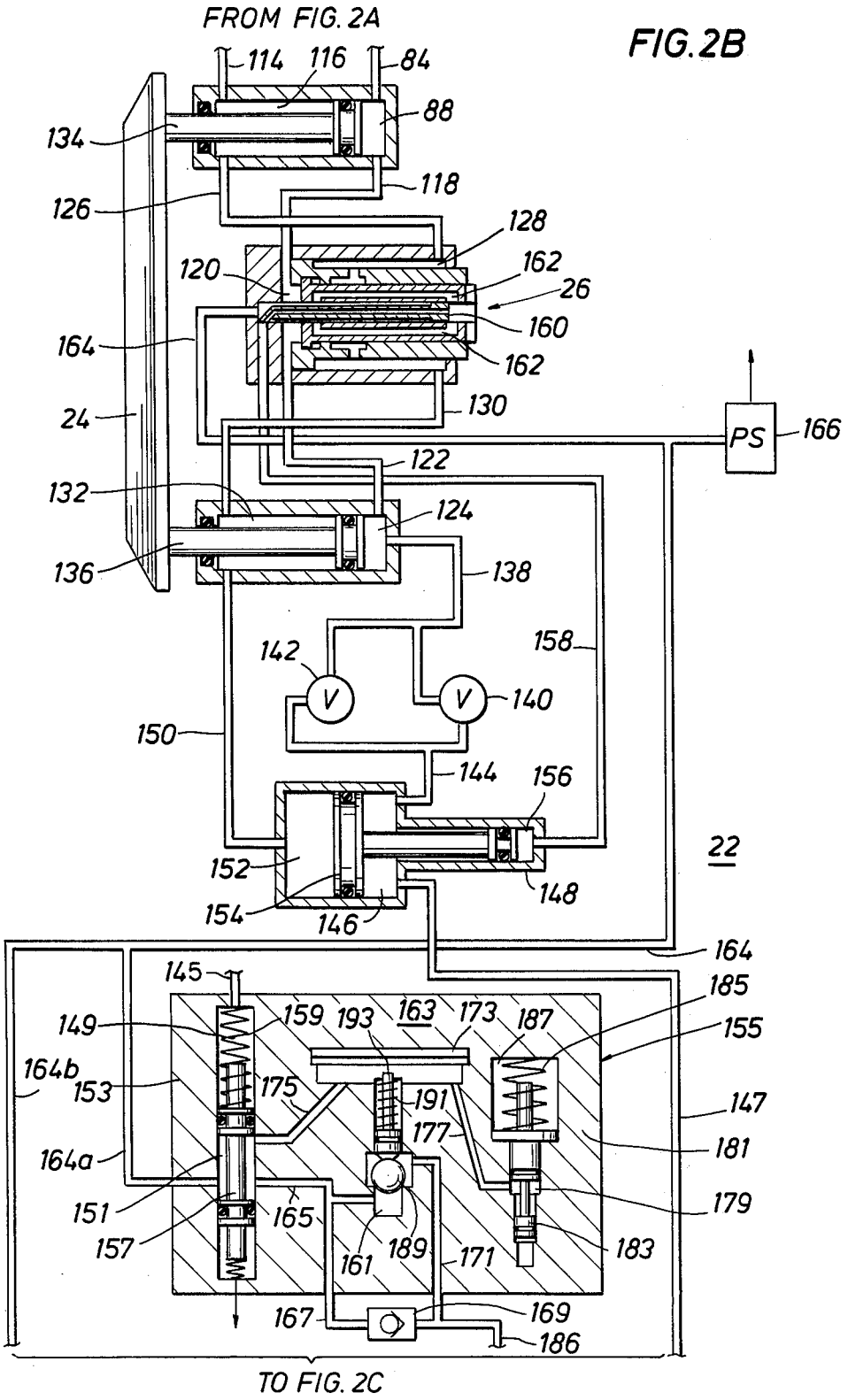
Figure 2C:
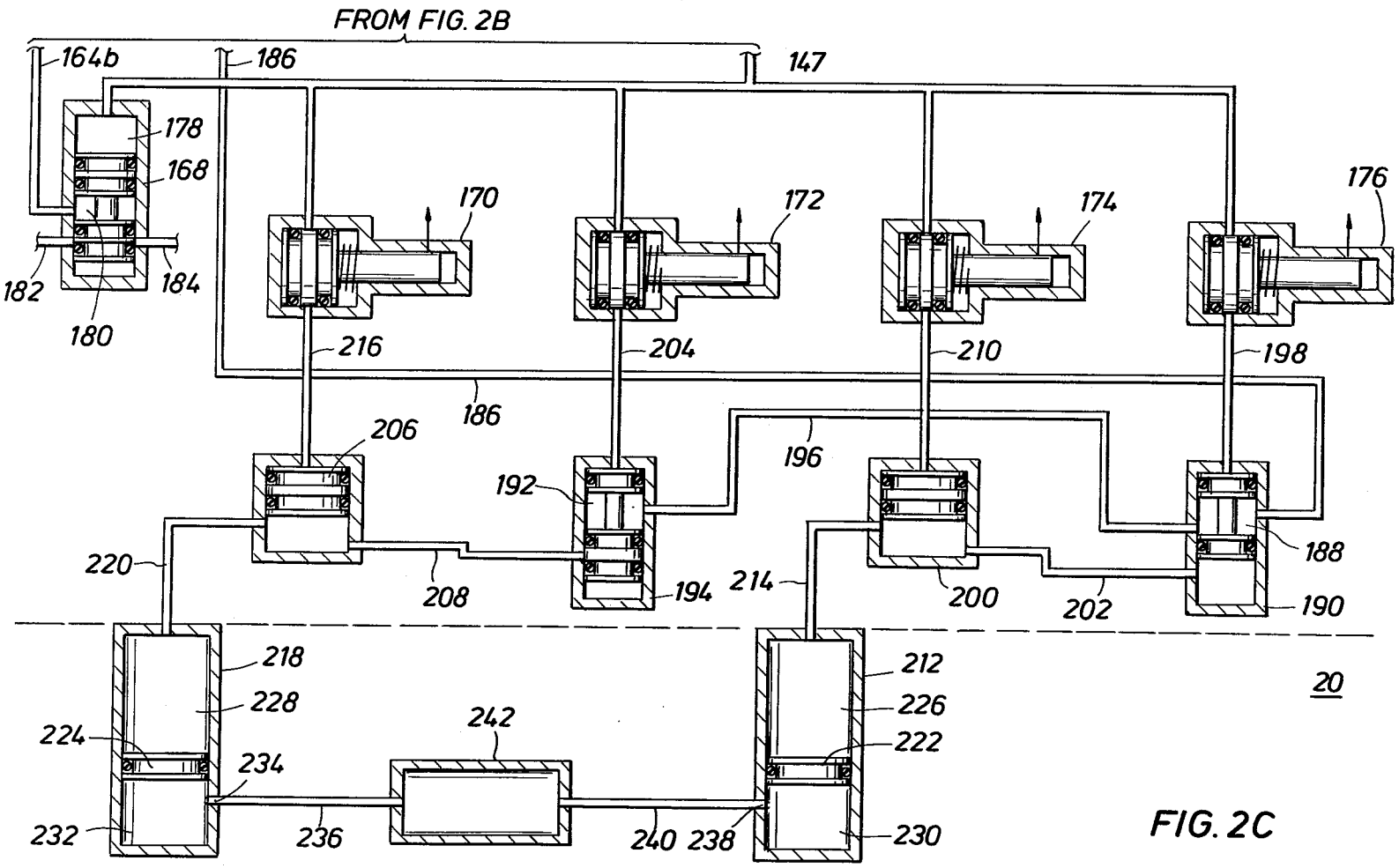

Referring now to FIGS. 2A through 2C, there is illustrated a somewhat-schematic representation of the hydraulic power system section 18, the sampling mechanism section 22 and the fluid sample storage section 20 of sampling and measuring instrument 16. The hydraulic power system section 18 includes an upper borehole fluid chamber 28, which is in fluid communication with the borehole through passage 30, and a lower hydraulic fluid chamber 32, which contains a hydraulic fluid such as oil or the like. Disposed between the upper borehole fluid chamber 28 and the lower hydraulic fluid chamber 32 is a free-floating isolation piston 34. Isolation piston 34 serves to not only isolate the upper borehole fluid chamber 28 from the lower hydraulic fluid chamber 32 but also maintains the hydraulic fluid within the hydraulic fluid chamber 32 at a pressure about equal to the hydrostatic pressure at whatever depth the tool is situated in the borehole, as well as for accommodating for volumetric changes in the hydraulic fluid which may occur under various borehole conditions. A passage 36 is provided within piston 34 from hydraulic fluid reservoir 32 to the outside periphery of isolation piston 34 between o-rings 38 and 40 to prevent pressure locking of the isolation piston 34.

Since sampling and measuring instrument 16 is to be operated at great depths within boreholes which can contain dirty and unusually corrosive fluids, housed within the protection of hydraulic fluid chamber 32 is hydraulic pump 42, which in the preferred embodiment is an electrically powered, rotary, positive-displacement type hydraulic pump. Hydraulic pump 42 has a first hydraulic line or conduit 44 connecting to fluid filter 46 which further communicates with lower hydraulic fluid chamber 32 by hydraulic line 48. A second hydraulic line 50 connects hydraulic pump 42 with fluid chamber 52 within valve assembly 54. Valve assembly 54 can comprise any suitable dual-position electrically controllable hydraulic valve, for example, such as Model NWE-5-N/6.0/OF-22V60NZ4V, sold by Rothrex, Inc. Branchingly connected to hydraulic line 50 is hydraulic line 56 which connects to pressure regulating valve 58 which further communicates with hydraulic fluid chamber 32 through hydraulic line 60.

Fluid chamber 52 of valve assembly 54, in the valve position shown, connects through hydraulic line 62 to a first check valve section 64 of dual pilot check valve 66. The output of first check valve section 64 is branchingly coupled through hydraulic line 68 to hydraulic fluid pressure sensor 70 and to electrically controllable dump valve 72. Dump valve 72 communicates with hydraulic fluid chamber 32 through hydraulic line 74. A second hydraulic line 76 from dump valve 72 connects to relief valve 78. From relief valve 78 a first hydraulic line 80 communicates with hydraulic fluid chamber 32 and a second hydraulic line 84 connects to well engaging member extender chamber 88.

A third hydraulic line 82 connects from valve assembly 54 to a second check valve section 86 of dual pilot check valve 66. The output of second check valve section 86 connects to relief valve 90 by hydraulic line 92. Relief valve 90 connects to hydraulic fluid chamber 32 through hydraulic line 94 and connects to well engaging member piston retractor chamber 116 through hydraulic line 114.

Well engaging member piston extender chamber 88 is coupled through hydraulic line 118 to fluid admitting member extender chamber 120 which is further coupled through hydraulic line 122 to well engaging member piston extender chamber 124. Well engaging member piston retractor chamber 116 is coupled through hydraulic line 126 to fluid admitting member retractor chamber 128 which is further coupled through hydraulic line 130 to well engaging member piston retractor chamber 132. Well engaging pad member pistons 134 and 136 are a longitudinally spaced pair of laterally movable pistons arranged traversely on the body of sampling and measuring instrument 16. Pistons 134 and 136 are arranged to provide contemporaneous expansion of well engaging pad member 24 and fluid admitting member 26. Conversely, pistons 134 and 136 cooperate to provide contemporaneous retraction of well engaging pad member 24 and fluid admitting member 26.

Piston extender chamber 124 couples to hydraulic line 138 which branchingly couples to relief valve 140 and check valve 142. Relief valve 140 and check valve 142 are coupled through hydraulic line 144 to fluid chamber 146 within pre-test sample assembly 148. Fluid chamber 146 is branchingly coupled through hydraulic line 147 to fluid chamber 178 of equalizer valve 168, solenoid valve 170, solenoid valve 172, solenoid valve 174 and solenoid valve 176. Solenoid valves 170, 172, 174 and 176 can be any suitable electrically controllable hydraulic control valves, such as those sold by ATKOMATIC VALVE COMPANY, under part number 15-885. These valves are controlled by an electrical command and switching system known in the art, such as the system described in U.S. Pat. No. 3,780,575, which is incorporated herein by reference.

Piston retractor chamber 132 is coupled through hydraulic line 150 to fluid chamber 152 within pre-test sample assembly 148. Fluid chamber 146 and fluid chamber 152 are fluidly isolated from one another by displacement piston 154. Pre-test sample assembly 148 includes an expansible pre-test fluid sample chamber 156 coupled through fluid line 158 to a central bore 160 within fluid admitting member 26. In the preferred embodiment, pre-test fluid sample chamber is designed to hold a relative small amount of formation fluids such as a volume from between 10 cc to 20 cc.

Fluid admitting member 26 is provided with second coaxial passages 162 connecting to fluid line 164 which branchingly connects to formation pressure sensor 166, and fluid chamber 180 within equalizer valve 168, by branch line **164*b*. Additionally, equalizer valve 168 can be placed in fluid communication with the borehole by conduits 182 and 184. Branch line 164***a* of fluid line 164 connects to fluid chamber 151 of divider valve section 153 of sample pressure control valve assembly 155. Divider valve section 153 is an electrically controllable solenoid valve having a slidable piston 157 disposed within fluid chamber 151. Piston 157 is biased into the position illustrated by spring 159 located in cavity 149. Cavity 149 is placed in fluid communication with the borehole through conduit 147.

Fluid chamber 151 of divider valve section 153 is fluidly coupled to cavity 161 of pressure restrictor section 163 by fluid line 165. Fluid line 167 branches from fluid line 165 providing fluid communication to one side of check valve 169. Cavity 161 is connected through fluid line 171 to the second side of check valve 169 and by fluid line 186 to fluid chamber 188 within first sample storage tank control valve 190. Additionally, fluid chamber 151 of divider valve section 153 is fluidly coupled to fluid chamber 173 of pressure restrictor section 163 by fluid line 175. Fluid chamber 173 is further connected through fluid line 177 to fluid chamber 179 of balance valve section 181 of sample pressure control valve assembly 155. Disposed within fluid chamber 179 is slidably piston 183 biased into the illustrated position by a combination of spring 185 and atmospheric pressure trapped within chamber 187.

Briefly returning to pressure restrictor section 163 of sample pressure control valve assembly, disposed within fluid chamber 161 is ball seat 189. In the position illustrated ball seat 189 is biased into sealing position, isolating fluid chamber 161 into two sections and thereby isolating input fluid line 165 from output fluid line 171. Ball seat 189 is biased into the illustrated position by a combination of spring bias provided by spring 191 exerting force on slidable plunger 193 and by fluid pressure exerted on slidable plunger 193 from any pressurized fluid within fluid chamber 173.

Turning now to FIG. 2C, fluid chamber 188 of first sample storage tank control valve 190 connects to fluid chamber 192 within second sample storage tank control valve 194 by fluid line 196. First sample storage tank control valve 190 connects to solenoid valve 176 by hydraulic line 198 and connects to first sample storage tank lock valve 200 by fluid line 202. Second sample storage tank control valve 194 connects to solenoid valve 172 by hydraulic line 204 and connects to second sample storage tank lock valve 206 by hydraulic line 208. First sample storage tank lock valve 200 couples to solenoid valve 174 by hydraulic line 210 and couples to the first sample storage tank 212 by fluid line 214. Second sample storage tank lock valve 206 couples to solenoid valve 170 by hydraulic line 216 and couples to the second sample storage tank 218 by fluid line 220. Sample storage tanks 212 and 218 are divided into two separate fluid cavities by floating pistons 222 and 224, respectively. The upper chamber of tank 212 comprises a fluid sample storage chamber 226 with the upper chamber of tank 218 forming a second fluid sample storage chamber 228. Lower chamber 230 of tank 212 and the lower chamber 232 of tank 218 comprise water reservoirs. Water reservoirs 232 and 230 are respectively coupled through flow control orifice 234 and water line 236, and flow control orifice 238 and water line 240 to water cushion storage tank 242.

In the operating of the sampling and measuring instrument of FIG. 2, instrument 16 is position within a borehole opposite earth formations to be tested. Borehole mud and fluids enter borehole fluid chamber 28 by passage 30 which communicates with the borehole 10. The weight of the borehole fluid column is exerted as hydrostatic pressure within borehole fluid chamber 28, with this hydrostatic pressure acting on isolation piston 34 to produce counterbalancing pressure in the hydraulic fluid of the power system. As the sampling and measuring instrument 16 is lowered into the borehole, the hydrostatic pressure increases and forces isolation piston 34 to move downward towards sampling mechanism section 22. The movement of piston 34 compresses the volume of the hydraulic fluid chamber 32, causing a corresponding increase in fluid pressure throughout the hydraulic system. Isolation piston 34 movement stops when the hydraulic system fluid pressure reaches a value approximately equaling the hydrostatic pressure. To prevent pressure locking of isolation piston 34, passage 36 supplies hydraulic fluid from hydraulic fluid reservoir 32 to the outside pheriphery of isolation piston 34, between o-ring seals 38 and 40.

When sampling and measuring instrument 16 is positioned within a borehole at a desired sampling location, energizing voltages from an electrical command unit (not shown) are supplied to motor driven hydraulic pump 42, valve assembly 54 and spring loaded dump valve 72. These command signals shift and hold the piston within fluid chamber 52 of valve assembly 54 to the pump forward (PF) position, as illustrated by the position of the piston in FIG. 2A; activates motor driven hydraulic pump 42; and maintains dump valve 72 in a de-energized position. The rotation of hydraulic pump 42 draws hydraulic fluid from hydraulic fluid reservoir 32 through hydraulic line 48, filter 46, hydraulic line 44 and into hydraulic pump 42 being further pumped through hydraulic line 50 into fluid chamber 52 of valve assembly 54. Hydraulic fluid is pumped also from hydraulic line 50 into branch hydraulic line 56 to pressure regulating valve 58. Pressure regulating valve 58 allows hydraulic fluid pressure flow to peak from preferable between 1700 psi and 1750 psi before unseating and opening a return path through hydraulic line 60 to hydraulic fluid chamber 32.

The PF hydraulic fluid flow travels from fluid chamber 52 through hydraulic line 62 to first check valve section 64 of dual pilot check valve 66. First check valve section 64 allows hydraulic fluid flow therethrough while pressure biasing second check valve section 86 of dual pilot check valve 66 in a closed position. Hydraulic fluid flow travels through hydraulic line 68 to dump valve 72 and through branch hydraulic line 69 to hydraulic fluid pressure sensor 70. Hydraulic fluid pressure sensor is preferably a Bourdon pressure gage which converts the hydraulic fluid pressure into an electrical signal which is transmitted to the surface electronic section (not shown). The PF hydraulic fluid flow moves through dump valve 72 and hydraulic line 76 to relief valve 78. Relief valve 78 is preset at a pressure level slightly higher than that at pressure regulating valve 58 to allow hydraulic fluid flow to return through hydraulic line 80 into hydraulic fluid chamber. Preferably, relief valve 78 is set to unseat from between 1725 psi and 1775 psi. PF hydraulic fluid flow moves through relief valve 78, through hydraulic line 84 into piston extender chamber 88, further passing through hydraulic line 118 into fluid admitting member extender chamber 120, continuing through hydraulic line 122 into piston extender chamber 124. The output signal from hydraulic fluid pressure sensor 70 increases as the hydraulic fluid pressure surge forces pistons 134 and 136 to move well engaging pad member 24 laterally in relation to the longitudinal axis of the movement into contact with the well of the borehole. Contemporaneous with the lateral extension of well engaging pad member 24, the PF hydraulic fluid pressure within fluid admitting member extender chamber 120 extends the components of the fluid admitting member 26 in a telescoping manner forcing the leading portion of fluid admitting member through any mud cakes present and into fluid communication with the earth formations. A more complete description of fluid admitting member 26 can be found in U.S. patent application, Ser. No. 310,249, which is incorporated herein by reference.

When the PF hydraulic fluid flow pressure reaches a predetermined value, such as, for example, 1200 psi, relief valve 140 unseats, passing hydraulic fluid flow through hydraulic line 144 into fluid chamber 146 of pre-test sample assembly 148, moving displacement piston 154 rearward within pre-test sample assembly 148. The rearward movement of displacement piston 154 causes any mud cakes and formation particles in central bore 160 of fluid admitting member 26 to be pulled rearwardly within central bore 160 and causes a relatively small formation fluid sample to be pulled through fluid line 158 into pre-test fluid sample chamber 156. The predetermined pressure threshold which unseats relief valve 140 is selected to be of a threshold which will assure that before formation fluids are taken into formation admitting member 26 for pre-test that both well engaging pad member 24 and fluid admitting member 26 are fully extended to and establish firm contact with the wall of the borehole, and that the leading portion of fluid admitting member 26 penetrates through any mud cakes on the wall of the borehole.

Figure 3:
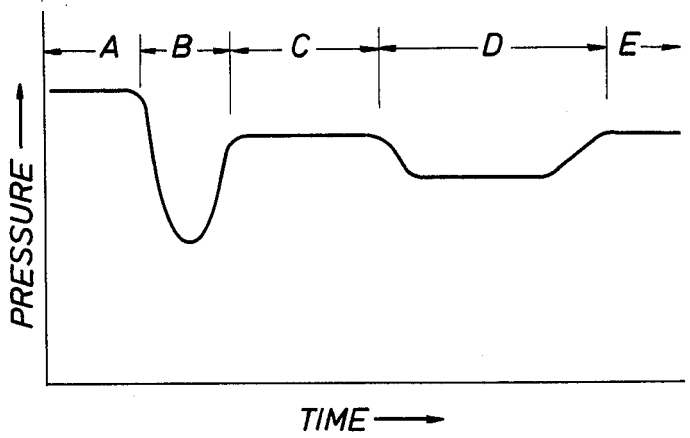
FIG. 3 graphically illustrates a typical pressure verses time relationship as measured by a fluid sample pressure transducer of the formation testing instrument.

As previously stated, the rearward movement of displacement piston 154 within pre-test sample assembly 148 pulls any mud cakes and formation particles lodged within central bore 160 rearwardly within central bore 160. The rearwardly movement of mud cakes and formation particles within central bore 160 opens a number of forwardly located lateral fluid passages connecting central bore 160 to a number of coaxial fluid passages 162, placing passages 162 into fluid communication through fluid line 164 to formation pressure sensor 166 equalizer valve 168, through branch line 164*b*, and to sample pressure control valve assembly 155, through branchline 164*a*. Formation pressure sensor 166 is preferably a strain gage functioning as an electrical resistance bridge. Formation fluid pressures alter the electrical resistance, imbalancing the electrical bridge producing an output voltage signal representative of the formation pressures. The formation pressure sensor 166 output signal is transmitted to the surface control unit. Illustrated in FIG. 3 is a graphic representation of the typical output signal from formation pressure sensor 166. As instrument 16 is located within a borehole formation pressure sensor output, interval A indicates a measurement of the hydrostatic pressure within the borehole. Shown by interval B, the signal will indicate an initial pressure drop as fluids intake into pre-test sample assembly 148, with a subsequent increase and leveling off to a stable pressure valve. Interval C of the curve of FIG. 3, indicating the initial shut-in pressure of connote fluids, if any, present within the pre-tested earth formations.

The unseating of relief valve 140, allowing hydraulic fluid flow into fluid chamber 146 of pre-test sample assembly 148, further allows hydraulic fluid flow through branch hydraulic line 147 to fluid chamber 178 of equalizer valve 168, solenoid valve 170, solenoid valve 172, solenoid valve 174 and solenoid valve 176. The PF hydraulic fluid pressure flow into fluid chamber 178 of equalizer valve 168 moves the valve piston thereby allowing passage of any formation fluids present in fluid line 164 and branch line 164*b* into fluid chamber 180. Further, formation fluids pass through branch fluid line 164*a* into fluid chamber 151 of divider valve section 153 of sample pressure control valve assembly 155. From fluid chamber 151, formation fluids passes through fluid lines 165 and 175 to cavities 161 and 173 of pressure restrictor valve section 163. Formation fluids further pass through fluid line 177 into fluid chamber 179 of balance valve section 181 and through fluid line 171 to fluid line 186 into fluid chamber 188 of first sample storage tank control valve 190, and through fluid line 196 into fluid chamber 192 of second sample storage tank control valve 194. Divider valve section 153 is activated by means of an electrical control signal causing piston 157 to move slidably into cavity 149 within divider valve section 153 against spring 159. The movement of piston 157 isolates fluid line 175 from fluid lines 164*a* and 165, thereby trapping pressurized formation fluids at the initial shut-in pressure within fluid line 175 fluid chamber 173, fluid line 177 and fluid chamber 179. The trapped pressurized formation sample exerts a force upon piston 193 further exerting a force upon ball 189, shifting ball 189 into a sealing state within fluid cavity 161, thereby isolating fluid line 165 from fluid line 171.

To collect a formation sample, an electrical command signal is transmitted to solenoid valve 176 which shifts the valve piston within solenoid valve 176 opening a PF hydraulic fluid path through line 198 to first sample storage tank control valve 190 shifting the piston in this valve, causing formation fluids to flow through fluid line 164, branch fluid line 164*a*, unseating ball 189 from its sealing position, through fluid cavity 161, fluid lines 171 and 186 and passing through fluid line 202, through first sample storage tank lock valve 200, which is a normally open lock valve, through fluid line 214 and into fluid sample storage chamber 226 of first sample storage tank 212. Piston 193 is designed to have a smaller diameter end located in fluid chamber 173 and a larger diameter end located in cavity 161 so that the formation fluid pressures are able to overcome the biasing on ball 189 caused by the formation fluid sample pressures within fluid chamber 173 and spring 191. Additionally, it will be noted that movement of piston into fluid chamber 173 displaces formation fluids from chamber 173 into fluid chamber 179 of balance valve section 181 moving piston 183 into cavity 187.

Referring again to FIG. 3, interval D indicates the opening of a sample storage tank control valve. It should be appreciated that whereas the curve of FIG. 3 clearly indicates a drop in fluid pressure while the sample tanks are filled, this drop is significantly less than the pressure drops encountered without sample line pressure control as provided by sample pressure control value assembly 155. Thus, by reducing the differential pressure between borehole hydrostatic pressure and pressure in the formation fluid sample line when a sample tank at or near atmospheric pressure is opened there is reduced the possibility of packer seal loss while collecting a sample.

When a suitable sample has been accumulated in sample storage chamber 226 an electrical command signal is transmitted to solenoid valve 174 opening a PF hydraulic fluid path through hydraulic line 210 to first sample storage tank lock valve 200 shifting the valve piston blocking the fluid path to first sample storage tank 212, with the collected fluid sample retained therein. In a similar manner, a fluid sample is collected and retained within second sample storage tank 218 by electrical command signals to solenoid valves 172 and 170. The pressure curve at interval E of FIG. 3 illustrates the final shut-in pressure of the formation as measured by formation pressure transducer 166.

Formation fluids entering fluid sample storage chamber 226 or fluid sample storage chamber 228 at their formation zone pressures moves the respective floating piston 222 or 224 toward the bottom of first sample storage tank 212 or second sample storage tank 218, respectively. The downward movement of floating piston 222 or 224 displaces fluid, such as water, contained within the appropriate water reservoir 230 or 232. Water is returned to water cushion tank 242 through flow control orifice 238 or 234 at a steady, predictable rate established by the size of the orifice. A more complete description of the water cushion system can be found in the aforementioned U.S. Pat. No. 3,011,554, which has been incorporated herein by reference.

When it is determined by the pre-test that the earth formations are unsuited for testing or when a formation sample has been obtained electrical command signals are transmitted to dump valve 72 and valve assembly 54, opening dump valve 72 through hydraulic line 74 into hydraulic fluid chamber 32 and shifting the piston in fluid chamber 52 of valve assembly 54 thereby opening hydraulic line 82 into fluid chamber 52 and sealing hydraulic line 62 therefrom. With valve assembly 54 in this position, rotation of hydraulic pump 42 provides pump reverse pressure flow (PR). Hydraulic pump 42 draws fluid from hydraulic fluid chamber 32 through hydraulic line 48, filter 46, and hydraulic line 44 into hydraulic pump 42 further being pumped through hydraulic line 50 into fluid chamber 52 of valve assembly 54. The pressurized hydraulic fluid passes through hydraulic line 82 and unseats check valve 86 entering hydraulic line 92 and flowing into pressure regulating valve 90. Pressure regulating valve 90 allows the PR flow pressure to peak preferably between 1700 and 1750 psi before unseating and opening a return line through hydraulic line 102 into hydraulic fluid chamber 32. Hydraulic pressure is coupled also to first check valve section 64 of dual pilot valve 66 for sealing purposes to prevent fluid bleed-back therethrough.

The PR hydraulic fluid flow passes from pressure regulating valve 90 through hydraulic line 144 into piston retractor chamber 116. From piston retractor chamber 116 hydraulic fluid pressure passes through hydraulic line 126 into fluid admitting member retractor chamber 128 further passing through hydraulic line 130 into piston retractor chamber 132. The PR hydraulic flow moves pistons 134 and 36 rearwardly retracting well engaging pad member 24 from contact with the borehole wall. On the opposite side of the sampling and measuring instrument 16 the PR hydraulic pressure flow telescopically retracts fluid admitting member 26. Moving from piston retractor chamber 132 through hydraulic line 150 hydraulic fluid flows into fluid chamber 152 of pre-test sample assembly 148 pushing displacement piston 154 forward. This movement of displacement piston 154 forces formation fluids within fluid chamber 156 through fluid line 158 and central bore 160 of fluid admitting member 26, forcing any mud cakes and formation particles in central bore 160 to be displaced and pushed into the borehole. Hydraulic fluid from fluid chamber 146 is displaced through check valve 142 into the PF hydraulic line system back into hydraulic fluid chamber 32.

Additionally, when hydraulic pump 42 operates to create PR hydraulic fluid flow spring-loaded piston of equalizer valve 168 shifts. In this valve position a borehole fluid path is provided through fluid lines 182 and 184 into fluid line 164 and coaxial fluid passage 162 returning to the borehole. The pressure of the borehole fluid flow counteracts the pressure exerted externally on fluid admitting member 26 by the borehole fluids and aids the PR pressure flow in retracting fluid admitting member 26. The borehole fluid flow also serves to clean any formation particles from coaxial fluid passages 162.

Many modifications and variations besides those specifically illustrated may be made in the techniques and structures described herein without departing substantially from the concept of the present invention. Accordingly, it should be understood that the forms of the invention described and illustrated herein are exemplary only, and are not intended as limitations on the scope of the present invention.

The embodiments of the invention in which an exclusive property or privilege is claimed are defined as follows:

1. Fluid sampling apparatus for obtaining samples of connate fluids from subsurface earth formations traversed by a borehole comprising:

a body member adapted for suspension in a borehole;

a fluid sampling probe cooperatively arranged on and extensible from said body member;

a sample collection means cooperatively arranged on said body member for receiving and retaining a sample of connate fluids;

a fluid passage coupled between said fluid sampling probe and said sample collection means; and control means located in said fluid passage intermediate said fluid sampling probe and said sample collection means for maintaining the pressure within at least a portion of said fluid passage at minimum level, said level proportionally related to formation pressure, and wherein said pressure control means comprises:

means for receiving and retaining a sample of said connate fluids; and pressure responsive means for restricting said fluid passage in proportional response to the pressure of said connate fluids sample retained in said receiving and retaining means.

2. The fluid sampling apparatus of claim 1, wherein said sample collection means comprises:

fluid sample storage means for receiving and retaining said fluid sample; and selectively operable control means for fluidly communicating and isolating said fluid passage with said fluid sample storage means.

3. The fluid sampling apparatus of claim 2, wherein said pressure control means comprises:

means for receiving and retaining a sample of said connate fluids; and pressure responsive means for restricting said fluid passage in proportional response to the pressure of said connate fluids sample retained in said receiving and retaining means.

4. The fluid sampling apparatus of claim 3, further comprising pressure measuring means cooperatively arranged on said body member for providing electrical signals representative of the pressure of said connate fluids.

5. Apparatus for collecting samples of the fluid content of earth formations traversed by a borehole, comprising:

an elongated body member adapted to traverse a borehole;

first sample collecting means cooperatively arranged on said body member for receiving a first sample of said fluid content;

second sample collecting means cooperatively arranged on said body member for receiving a second sample of said fluid content;

a selectively extensible and retractable fluid sampling probe cooperatively arranged on said body member;

fluid passage means coupled between said probe and said first and second sample collection means; and control means located in said fluid passage means intermediate said probe and said second sample collecting means for maintaining the pressure within at least a portion of said fluid passage means at a pressure level proportionally related to the pressure of said earth formations subsequent to said first sample of fluid content and, wherein said control means comprises:

third sample collecting means for receiving a third sample of said fluid content; and means for restricting fluid communication between said probe and second sample collecting means in response to the pressure of said third fluid sample.

6. The sample collecting apparatus of claim 5, further comprising hydraulic power means for extending and retracting said probe.

7. The sample collecting apparatus of claim 5, wherein said first sample collecting means comprises:

selectively expansible fluid sample storage means for receiving and retaining said first fluid sample; and pressure sensitive means for expanding said storage means at a predetermined hydraulic fluid pressure generated by said hydraulic power means.

8. The sample collecting apparatus of claim 7, wherein said second collecting means comprises:

fluid sample storage means for receiving and retaining said second fluid sample;

first selectively operable valve means for fluidly connecting said fluid sample storage means with said fluid passage means; and second selectively operable valve means for fluidly isolating said fluid sample storage means from said fluid passage means.

9. The sample collecting apparatus of claim 8, wherein said control means comprises:

third sample collecting means for receiving a third sample of said fluid content; and means for restricting fluid communication between said probe and second sample collecting means in response to the pressure of said third fluid sample.

10. The sample collecting apparatus of claim 9, further comprising pressure measuring means for providing electrical signals representative of said formations.

11. The sample collecting apparatus of claim 10, further comprising pressure measuring means for providing electrical signals representative of the hydraulic fluid of said hydraulic power means.

12. Apparatus for collecting samples of the fluid content of earth formations traversed by a borehole, said apparatus including an elongated body member adapted to traverse said borehole, comprising:

fluid sample collecting means cooperatively arranged on said body member for receiving a sample of said fluid content;

probe means cooperatively arranged on said body member for fluidly connecting said body member with said earth formations;

a fluid passage connecting said probe means with said sample collecting means; and means for maintaining the pressure level within said fluid passage to at least a predetermined proportional relation to said formation pressure and, wherein said pressure level maintaining means comprises:

a fluid sample collection chamber coupled to said fluid passage; a selectively operable valve for isolating said fluid sample collection chamber from pressure fluid passage; and pressure responsive means for restricting said fluid within said fluid passage in functional relation to the pressure of a fluid sample isolated within said fluid sample collection chamber.

13. The sample collecting apparatus of claim 12, wherein said pressure level maintaining means comprises: a fluid sample collection chamber coupled to said fluid passage;

a selectively operable valve for isolating said fluid sample collection chamber from said fluid passage; and pressure responsive means for restricting said fluid passage within said fluid passage in functional relation to the pressure of a fluid sample isolated within said fluid sample collection chamber.

14. The sample collection apparatus of claim 13, wherein said pressure response means comprises:

sealing means for restricting said fluid passage; and biasing means for exerting sealing pressure on said sealing means in proportional relation to the pressure of said fluid sample within said fluid sample collection chamber.

15. The pressure response means of claim 14, further comprising expansion chamber means coupled to said fluid sample collection chamber for providing controlled displacement of said fluid sample contained therein.

16. The sample collection apparatus of claim 13, wherein the pressure of said fluid sample within said fluid sample collection chamber is at approximately formation shut-in pressure.

* * * * *